US005282933A

United States Patent [19]

Bubik et al.

[11] Patent Number: 5,282,933

[45] Date of Patent: Feb. 1, 1994

[54] WET SECTION FOR A TWIN WIRE PAPERMAKING MACHINE

[75] Inventors: Alfred Bubik; Hans Dahl; Karl Muller; Heinz Braun; Thomas Schaible, all of Ravensburg; Helmut Storr, Berg-Vorberg; Heinz Steckenreuter, Ravensburg, all of Fed. Rep. of Germany

[73] Assignee: Sulzer Escher Wyss GmbH, Ravensburg, Fed. Rep. of Germany

[21] Appl. No.: 795,181

[22] Filed: Nov. 19, 1991

[30] Foreign Application Priority Data

Nov. 20, 1990 [DE] Fed. Rep. of Germany ..... 4037017

[51] Int. Cl.[5] ..... D21F 1/00

[52] U.S. Cl. ..... 162/301; 162/203; 162/300

[58] Field of Search ..... 162/300, 301, 203, 352, 162/348

[56] References Cited

U.S. PATENT DOCUMENTS 4,176,005 11/1979 Bubik et al. ..... 162/301
4,417,950 11/1983 Bubik et al. ..... 162/300
4,609,435 9/1986 Tissari ..... 162/352
4,830,709 5/1989 Turner et al. ..... 162/301
4,925,531 5/1990 Koski ..... 162/301
5,019,214 5/1991 Meinecke et al. ..... 162/301

FOREIGN PATENT DOCUMENTS 251778 1/1988 European Pat. Off. ..... 162/301
3138133 3/1986 Fed. Rep. of Germany .
3910892 10/1990 Fed. Rep. of Germany .

*Primary Examiner*—Karen M. Hastings
*Attorney, Agent, or Firm*—Sandler, Greenblum & Bernstein

[57] ABSTRACT

The wet section of a twin wire papermaking machine is provided with an open forming roll at the lower wire and with the combination of a suction box at the lower wire and a vacuum suction box at the upper wire. Furthermore, by selecting the elevational position or level of the individual wire sections there can be obtained particularly advantageous conditions for the operation of the papermaking machine throughout a wide field of application, especially heavy types of paper at relatively low operating velocities of the papermaking machine. Gap-former and hybrid-former constructions of the papermaking machine are possible.

15 Claims, 3 Drawing Sheets

WET SECTION FOR A TWIN WIRE PAPERMAKING MACHINE

BACKGROUND OF THE INVENTION

1. Field of the Invention

The present invention relates to a new and improved wet section of a twin wire papermaking machine.

Generally speaking, the wet section of the twin wire papermaking machine is of the type comprising two revolving endless wires, especially an upper wire and a lower wire, travelling in a predetermined direction of movement. The web-supporting portion of the lower wire has a section which extends in essentially horizontal direction, and at one region the upper and lower wires are guided together. Further, there is provided at least one headbox from which emerges the fiber stock suspension in a wide jet which arrives at the one region between both of the guided together upper and lower wires where there is dewatered the fiber stock suspension and the web formed therefrom.

2. Discussion of the Background and Material Information

As a general rule, such type papermaking machines are employed for the manufacture of a paper or cardboard web —hereinafter sometimes generally simply broadly referred to as a paper web—which is formed by dewatering a fiber stock suspension at a wire or between two wires.

It is well known in the papermaking art that there are available quite a number of different constructions of papermaking machines of the aforementioned type. For example, in the commonly assigned German Patent No. 3,138,133, published Mar. 24, 1983, there is schematically disclosed in FIGS. 1, 2 and 3 papermaking machines which, through the use of an upper wire and a lower wire, render possible the fabrication of a paper 3,910,892, published Oct. 11, 1990, there is disclosed the forming region of a twin wire papermaking machine comprising a forming roll located at the lower wire and a section of the twin wire which extends upwardly over a curved forming shoe.

However, the heretofore known papermaking machines of this type are afflicted with the drawback that the operating range thereof is limited in that such papermaking machines can not be operated at velocities below a predetermined value and then only when producing paper products of relatively low basis weight, for example, paper used for printing newspapers. Such prior art papermaking machines possess the feature that the centrifugal force present at the forming roll, at velocities particularly below 500 meters per minute, is too small in order to adequately upwardly propel the water of the stock suspension and to remove such water at a collecting vat or trough provided for such water. This aspect of water removal is additionally made more difficult due to the fact that such papermaking machines exhibit an ascending course of the forming wire as viewed in the lengthwise direction of the papermaking machine, also referred to as the machine direction, in other words, in the direction of travel of the forming wire. Additionally, by virtue of the ascent of the guidance of the forming wire at the sheet forming zone of the papermaking machine there can arise differential velocities between the fiber stock suspension and the forming wire, resulting in alignment of the fibers in the lengthwise or machine direction of the papermaking machine.

This phenomenon is attributable, on the one hand, to a deceleration of the flow velocity of the fiber stock suspension due to having to overcome an increase in height in accordance with Bernoulli's equation. A further reduction in the velocity of the fiber stock suspension is caused by the presence of additional friction and stock turning losses due to the presence of the suction boxes.

The result of all of this is that there occurs a relatively pronounced fiber alignment in the lengthwise direction of the papermaking machine. The tear length ratio, namely L/Q, measured in the lengthwise and transverse directions of the paper web, can lie in the range of 2.5 to 4, which is frequently undesirable, for example, during the manufacture of liner or test liner paper or board or the like. In that case, there is desired a relatively low L/Q ratio in the order of between 1.0 and 1.5.

Furthermore, when there are present relatively high web weights, drawbacks arise by virtue of the small selected wrap angle at the forming roll of the prior art papermaking machines. At the subsequent region of the papermaking machine there also prevails the danger that the paper web is unduly compressed by the action of the forming elements arranged at the upper wire when there is present a high sheet weight or basis weight of the paper web.

A different construction of papermaking machine, as for example disclosed in U.S. Pat. No. 4,830,709, granted May 16, 1989, is devoid of any forming roll at the lower wire. Moreover, the first suction box at the lower wire, as viewed in the machine direction, is ascendingly arranged. Consequently, the water effluxing through the upper wire can flow back opposite to the machine direction, especially in the presence of relatively low machine velocities. Also, with this construction of papermaking machine there is not present any upper apex point of the lower wire at the front section or region of the sheet formation.

SUMMARY OF THE INVENTION

Therefore, with the foregoing in mind, it is a primary object of the present invention to provide an improved twin wire papermaking machine which is not afflicted with the aforementioned shortcomings and drawbacks of the prior art.

Another and more specific object of the present invention aims to provide an improved twin wire papermaking machine which can be advantageously employed for the manufacture of paper or the like throughout a wide range of operating velocities and for the most varied basis weights of the fabricated paper or the like.

Still a further noteworthy object of the present invention and in keeping with the immediately preceding object relates to an improved twin wire papermaking machine wherein the former can be advantageously used for the manufacture of paper or the like having a web weight in the order of between 30 grams/$^2$ and 300 grams/m$^2$ and at machine velocities in the range of from 200 meters/min. to beyond 1000 meters/min.

Now in order to implement these and still further objects of the present invention, which will become more readily apparent as the description proceeds, the wet section of the papermaking machine of the present development is manifested, among other things, by the features that a forming roll is provided in the lower wire and about which there is partially trained both the upper and lower wires. In the lower wire there is provided at least one suction box, and in the upper wire there is provided at least one top or upper suction device. Downstream of the at least one top or upper suction device, as viewed with respect to the predetermined direction of movement of the upper and lower wires, there is arranged at least one vacuum suction box in the upper wire, and downstream of the at least one vacuum suction box, as viewed with respect to the predetermined direction of movement of the upper and lower wires, there is arranged at least one separation element in the lower wire, especially a separation suction device or a separation roll.

By virtue of the aforementioned combination of features as contemplated by the present invention, the wet section of the papermaking machine is designed such that at the region of the twin wire wrap established at the forming roll there arises a favorable formation of the web with effective dewatering of the web. In this regard, a positive effect is realized by virtue of the geometric conditions which exist at this region, such as, for instance, the relatively large wrap angle of both wires at the forming roll, which is in the order of about 45°, as well as the rapid unhindered removal of the water. This is achieved if the forming section arranged after the forming roll, extends at least partially downwardly in the direction of the force of gravity. The losses in the flow velocity of the fiber stock suspension caused by the suction boxes at the upper and lower wires are at least partially compensated by the acceleration of the fiber stock suspension between the upper and lower wires due to the action of the force of gravity.

The water effluxing at the upper wire is removed above the upper wire by a top or upper suction device. Following the forming roll both the upper and lower wires are either guided substantially horizontally, descendingly or slightly ascendingly over one or more curved surfaces, and further forming of the web is accomplished due to the suction action of the at least one suction box at the lower wire and the vacuum suction box at the upper wire.

According to a further feature of the present invention, the upper apex point of the forming roll is situated at a higher elevational position than the web-supporting portion of the lower wire which has a section extending in essentially horizontal direction.

As to a still further feature, the upper apex point of the forming roll constitutes the highest point of the lower wire.

It is contemplated to provide at least one further suction box in the lower wire. Also a suction roll can be provided in the lower wire.

Still further, the at least one suction box provided in the lower wire contacts the uppermost point of the lower wire.

It is further contemplated to arrange the at least one top or upper suction device provided in the upper wire between the forming roll and the at least one suction box provided in the lower wire.

According to a further aspect, the at least one suction box provided in the lower wire has a surface contacted by the lower wire, and at least part of this surface contacted by the lower wire, as viewed in the predetermined direction of movement of the upper and lower wires, is substantially convexly curved with respect to the lower wire.

According to another feature, the at least one vacuum suction box provided in the upper wire has a surface contacted by the upper wire, and at least part of this surface contacted by the upper wire, as viewed in the predetermined direction of movement of the upper and lower wires, is substantially convexly curved with respect to the upper wire.

A further development of the present invention contemplates that the front edge of the at least one vacuum suction box provided in the upper wire is located at a greater elevational positional than the section of the lower wire which extends in essentially horizontal direction.

Moreover, the at least one suction box provided in the lower wire has a predetermined length in the predetermined direction of movement of the lower wire and the at least one vacuum suction box provided in the upper wire has a predetermined length in the predetermined direction of movement of the upper wire. The predetermined length of the at least one vacuum suction box provided in the upper wire is greater than the predetermined length of the at least one suction box provided in the lower wire.

According to a further feature, pressure elements are arranged beneath the at least one vacuum suction box provided in the upper wire and these pressure element means are elastically pressable towards the lower wire.

Still further, the at least one separation element includes an active surface arranged intermediate planes extending through the upper apex point and the lower apex point of the forming roll.

It is also contemplated to arrange the at least one headbox forwardly of the forming roll so as to define a gap former. Such at least one headbox can comprise a multi-ply headbox.

According to a further concept, a longitudinal wire section provided with the at least one headbox is arranged forwardly of the forming roll so as to define a hybrid former. This longitudinal wire section advantageously constitutes part of the lower wire.

A further aspect envisages the lower wire including a rear portion as viewed with respect to the predetermined direction of movement of the upper and lower wires, and this rear portion of the lower wire extends in substantially horizontal direction. Moreover, such rear portion of the lower wire can be arranged downstream of the at least one separation element as viewed with respect to the predetermined direction of movement of the upper and lower wires.

Furthermore, the invention also foresees that the at least one top suction device provided in the upper wire defines a first top suction device, and that a second upper suction device is provided in the upper wire. Additionally, the at least one suction box provided in the lower wire defines a first vacuum suction box, and a second vacuum suction box is provided in the lower wire.

Moreover, it is possible for the first vacuum suction box to have a surface contacting the lower wire which is substantially flat and the second vacuum suction box to have a surface contacting the lower wire which is substantially convex with respect to the lower wire.

As to a further feature of the present invention, the at least one vacuum suction box provided in the upper wire has a surface which contacts the upper wire and this surface comprises a first portion which is substantially flat and a subsequently arranged second portion which is substantially convexly curved with respect to the upper wire.

According to a still further feature, the total length of the upper and lower wires contacted by the suction boxes provided in the upper and lower wires is greater than the circumferential length of the forming roll wrapped by the upper and lower wires.

A further development of the invention contemplates that the suction boxes in the upper and lower wires define a forming path and the entire forming path descends as viewed with respect to the predetermined direction of movement of the upper and lower wires.

BRIEF DESCRIPTION OF THE DRAWINGS

The invention will be better understood and objects other than those set forth above, will become apparent when consideration is given to the following detailed description thereof. Such description makes reference to the annexed drawings wherein there have been generally used throughout the various figures the same reference characters to denote the same or analogous components and wherein.

DETAILED DESCRIPTION OF THE PREFERRED EMBODIMENTS

Describing now the drawings, it is to be understood that only enough of the construction of the different embodiments of a wet section of a papermaking machine has been depicted therein, in order to simplify the illustration, as needed for those skilled in the art to readily understand the underlying principles and concepts of the present invention.

Figure 1:
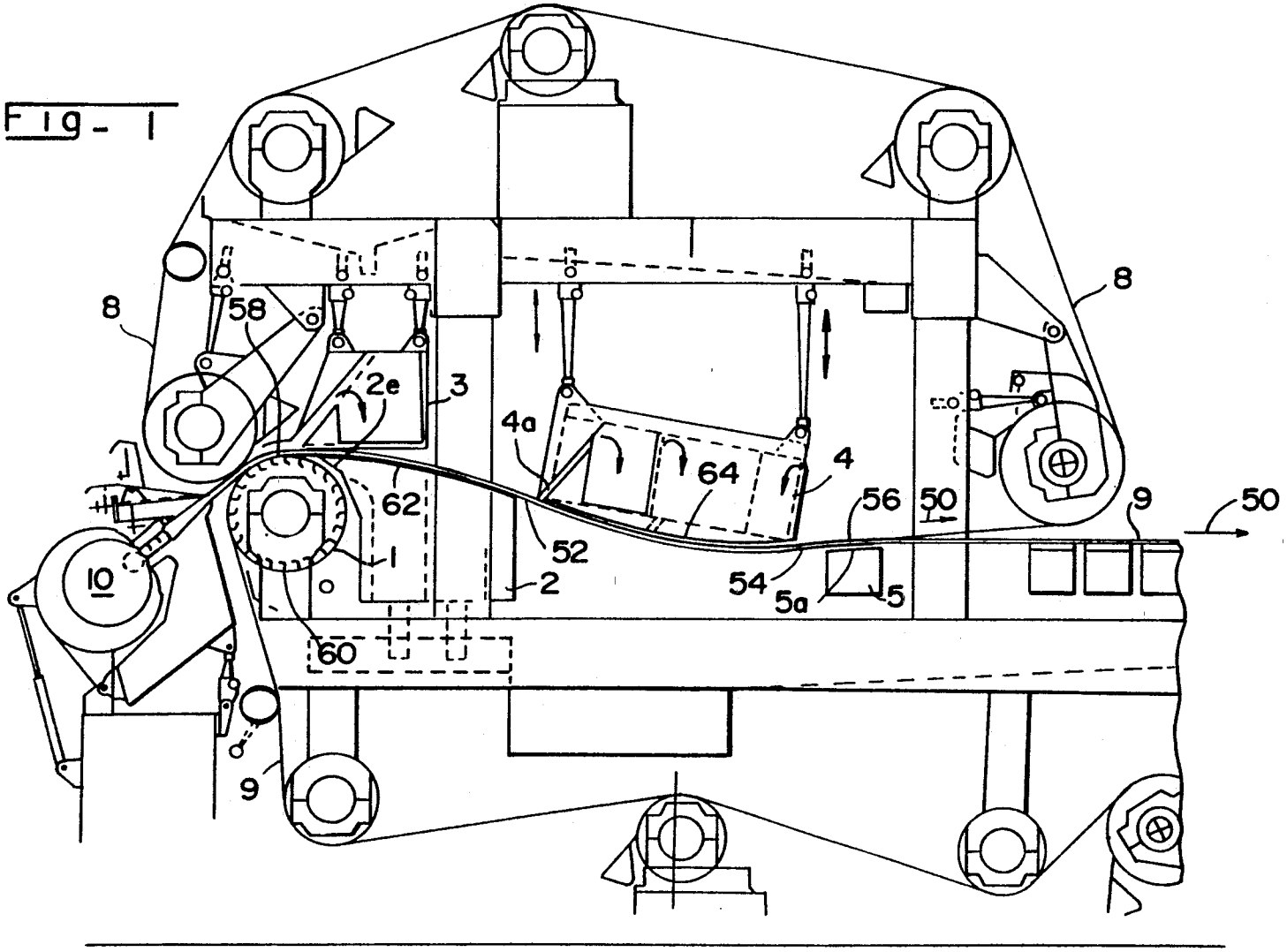
FIG. 1 is a schematic side view of the wet section of a papermaking machine according to the present invention and defining a gap former.

Turning attention now to FIG. 1, there is disclosed therein a most preferred embodiment of the wet section of a papermaking machine which is equipped with a headbox 10 from which emerges a fiber stock suspension jet, for example, a wide stock suspension jet which directly arrives between both of the converging forming wires 8 and 9, specifically the upper wire 8 and the lower wire 9. These upper and lower wires 8 and 9 travel in a predetermined direction of movement as indicated by the arrows 50 in FIG. 1 in order to form therebetween the web forming section 52 of the papermaking machine. Furthermore, it will be seen that the lower wire 9 contains a web supporting portion 54 having a section 56 extending in essentially horizontal direction and defining a rear portion of the lower wire 9.

Downstream of the headbox 10, which can be a multi-ply headbox, there is arranged a forming roll or roller 1, here, for instance, an open forming roll, about which there is partially trained at one region of the web forming section 52 both of the upper and lower wires 8 and 9, yet at a region forwardly of the place where there are wrapped both of these wires 8 and 9 this forming roll 1 is only partially wrapped by the lower wire 9. Since here the headbox 10 is arranged directly forwardly of the forming roll 1 the arrangement defines a so-called gap former, as is also the case for the modified embodiments of FIGS. 2 to 4.

In the embodiment under consideration, the departure of both of the travelling forming wires 8 and 9 from the forming roll 1 occurs at the upper right-hand region of such forming roll 1. This forming roll I can comprise a grill structure which is secured to a closed shell body. The water of the stock suspension can be temporarily stored or collected at the forming roll 1 and then can be propelled out of such forming roll 1 due to the action of the prevailing centrifugal force. This forming roll 1 also can be designed as a suction roll. Forming roll 1 can have a radius in the order of between 0.3 to 1 meter. Furthermore, this forming roll 1 has an upper apex point 58 and a lower apex point 60. The upper apex point 58 will be seen to constitute the highest point of the lower wire 9. Moreover, the upper apex point 58 of the forming roll 1 is situated at a higher elevational position than the web-supporting portion 54 of the lower wire 9 which has the section 56 extending in essentially horizontal direction.

The water of the fiber stock suspension which departs through the upper wire 8 is removed by means of a top or upper suction device 3 with or without the assistance of vacuum. The top or upper suction device 3 is shown arranged between the forming roll 1 and a suction box 2 provided in the lower wire 9. The suction box 2 has a surface 62 contacted by the lower wire 9 and at least part of this surface 62 is substantially convexly curved with respect to the lower wire 9. This top or upper suction device 3 can contact the upper wire 8, immerse into such upper wire 8 or advantageously can be spaced from such upper wire 8. Consequently, there can be avoided the presence of too great shearing forces at the fiber stock suspension which, for the here contemplated field of application, would be disadvantageous. Downstream of the forming roll 1, that is, as viewed with regard to the direction of movement 50 of the upper and lower wires 8 and 9, both of these wires 8 and 9 are transported in substantially horizontal direction, descending direction or slightly ascending direction over the suction box 2, or also a plurality of such suction boxes, each of which can comprise arched or domed surfaces provided with transverse ledges or the like. The radius of curvature of such domed suction box or boxes 2 amounts to between 2 and 20 meters. However, it is here specifically pointed out that there also can be used an arrangement in which the suction box contains a straight section or portion, for example, at the terminal region thereof, so that there is ensured a relatively gentle directional reversal of both of the wires 8 and 9 without danger of damage to the formed web. The suction box or boxes 2 at the lower wire 9 can be operated with or without vacuum. Moreover, the open surface of the suction box 2 can amount to between 20% and 80%. Furthermore, each of the suction boxes 2 can be provided with ledges extending in the cross-machine direction over the width thereof and/or with a hole or perforation pattern. As will be seen by inspecting FIG. 1, the suction box 2 provided in the lower wire 9 will be seen to have a portion 2e which contacts the uppermost point of such lower wire 9.

Figure 3:
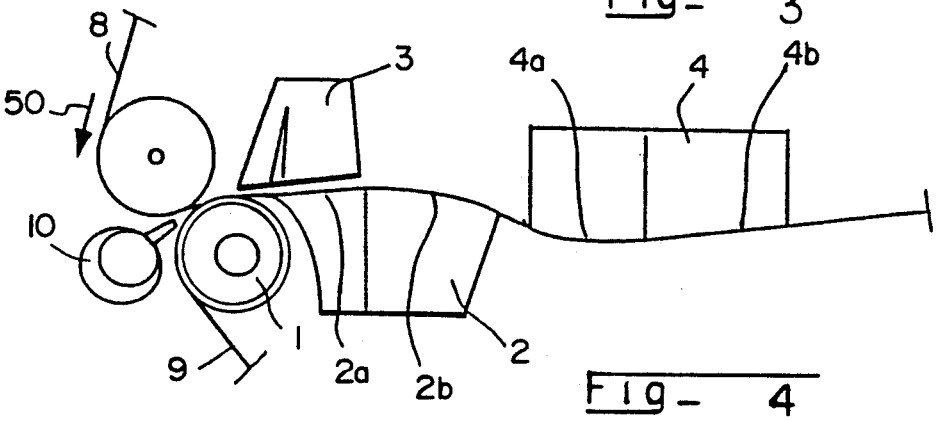
FIG. 3 is a schematic side view of a third embodiment of the wet section defining the forming region of a papermaking machine according to the present invention and defining a gap former.
Figure 4:
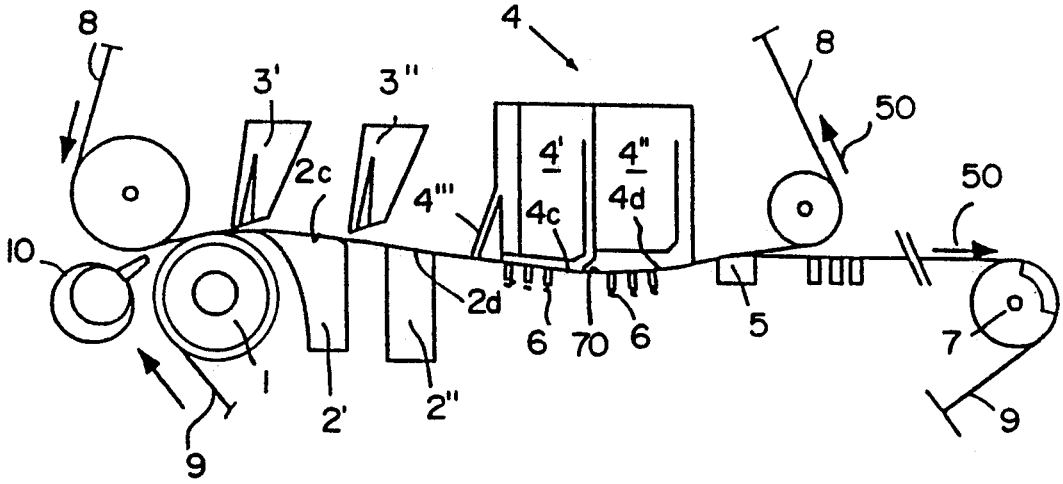
FIG. 4 is a schematic side view of a fourth embodiment of the wet section of a papermaking machine according to the present invention defining a gap former and embodying separated suction boxes.
Figure 5:
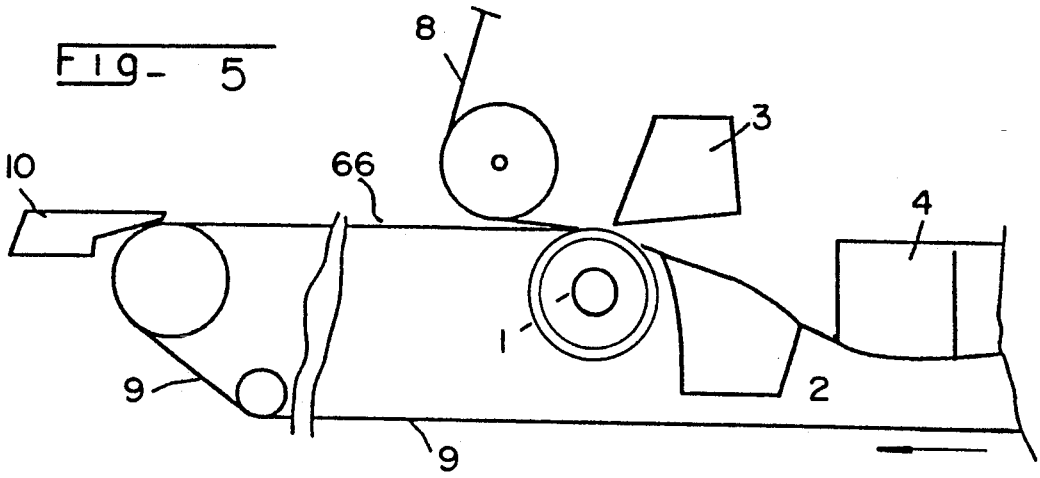
FIG. 5 is a schematic side view of a fifth embodiment of the wet section of a papermaking machine according to the present invention defining a hybrid former.
Figure 6:
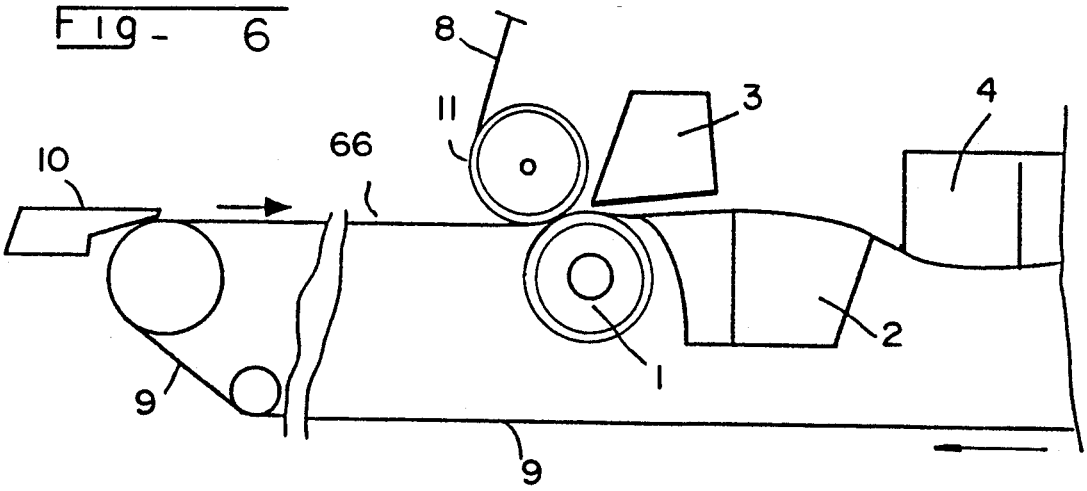
FIG. 6 is a schematic side view of a sixth embodiment of the wet section of a papermaking machine according to the present invention defining a hybrid former.

In the embodiments of FIGS. 1 and 5, immediately downstream of the forming roll 1 both of the wires 8 and 9 are transported in descending direction over the curved suction box 2, and in the embodiment of FIG. 4 such descending travel of these wires 8 and 9 is over the separate suction boxes 2' and 2''. On the other hand, in the embodiment of FIG. 2 these wires 8 and 9 initially ascend from the forming roll 1 over a starting region of the curved suction box 2 and then travel in descending fashion thereover. In the embodiments of FIG. 3 and 6 the wires 8 and 9 leave the forming roll 1 in substantially horizontal direction and for the most part travel in this disposition over the adjacent suction box 2.

Continuing, it will be seen that at the upper wire 8 there is provided a vacuum suction box 4 which comprises a number of chambers or compartments which can be operated with different vacuums. This vacuum suction box 4 has a surface 64 contacted by the upper wire 8 and at least part of such surface 64 is substantially convexly curved with respect to such upper wire 8. Also such vacuum suction box 4 has a front edge 4a which is located at a greater elevational position than the section 56 of the lower wire 9 which extends in essentially horizontal direction. An inclined disposition of the vacuum suction box 4, here, as shown, descending in the direction of travel of the revolving endless wires 8 and 9, facilitates the removal of water from the web at the starting region of the vacuum suction box 4, particularly at relatively low operating velocities or speeds of the papermaking machine, for instance, amounting to approximately 200 meters/min. At greater machine velocities water which has been outwardly propelled by centrifugal force above the suction box or boxes 2 arranged at the lower wire 9 can be readily removed by individual additional top or upper suction devices 3. It is here further indicated that in the arrangement of FIG. i and as viewed in the direction of movement 50 of the upper and lower wires 8 and 9, the length of the vacuum suction box 4 provided in the upper wire 8 is greater than the length of the suction box 2 provided in the lower wire 9.

Downstream of the vacuum suction box 4 there is located a separation or separating element 5 which is located upstream of the horizontally extending rear portion 56 of the lower wire 9. In the embodiment of FIG. 1, this separation or separating element 5 comprises a curved box containing ledges extending over the width thereof in the cross-machine direction and having a radius of curvature in the order of between 1.5 meters and 20 meters. This separation or separating element 5 has an active surface 5a which here is located at a position intermediate the planes extending through the upper apex point 58 and lower apex point 60 of the forming roll 1. As a modification, this box defining the separation or separating element 5, can comprise a linear or straight box which is operated under vacuum conditions. It is also conceivable to use a register roll as the separation or separating element 5.

Figure 2:
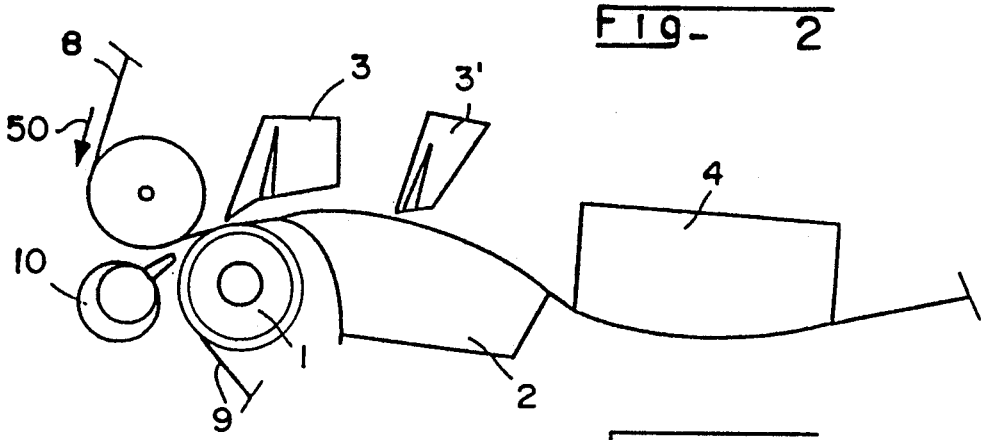
FIG. 2 is a schematic side view of a second embodiment of the wet section defining the forming region of a papermaking machine according to the present invention and defining a gap former.

FIG. 2 schematically depicts and without greater detail a different possible course of the converging or joined together upper and lower wires 8 and 9 at the region between the forming roll 1 and the vacuum box 4, as previously considered. It will be observed that the vacuum box 2 initially has a slightly ascending contour or shape followed by a more pronounced descending contour or shape.

The modification of FIG. 3 demonstrates the possibility that the suction box 2 and the vacuum suction box 4 not only can comprise curved contours but also straight contours at the surfaces contacted by the upper and lower wires 8 and 9. In this way there can be achieved a particularly protective removal of water from the formed web and thus a favorable web formation, especially with relatively heavy web weights. As here illustrated, it is possible to select a form of the suction boxes 2 and 4 where the surface contacted by the associated wire 8 or 9, as the case may be, first has a straight or planar shape followed by a curved shape, but also the converse arrangement can be of advantage depending upon the requirements and prevailing geometric conditions. More specifically, it will be seen that the suction box 2 has a substantially linear surface 2a followed by a curved or arcuate surface 2b, which surfaces 2a and 2b are contacted by the lower wire 9. On the other hand, the suction box 4 has a somewhat curved or arched surface 4a followed by a substantially straight or linear surface 4b, and these surfaces 4a and 4b are contacted by the upper wire 8.

FIG. 4 depicts a further embodiment comprising an arrangement containing a suction box 2' arranged at the lower wire 9 and having a curved or domed form at the surface 2c thereof which is contacted by such lower wire 9. Arranged following or downstream of this suction box 2' is a second or further suction box 2'' having a substantially linear or straight surface 2d with respect to the adjacent lower wire 9. Within the upper wire 9 there are provided the separate top or upper suction boxes 3' and 3''. The vacuum suction box 4 arranged at the upper wire 8 is sub-divided into a number of regions or zones or chambers, namely, the region or zone 4' which is followed by the further region or zone 4'' and which are operated at different vacuums or negative pressures, and at the upstream region of this vacuum suction box 4 there is provided an extra or supplementary suction device 4'''.

Moreover, it will be seen in FIG. 4 that the lower wire 9 is provided with a suction roll 7 located at the downstream end of the lower wire 9 with respect to the predetermined direction of movement 50 of the revolving endless upper and lower wires 8 and 9. Furthermore, pressure elements 6, such as elastic ledges, are arranged beneath the vacuum suction box 4 and are elastically pressable in the direction of the lower wire 9. Finally, it is here observed that the vacuum suction box 4 provided in the upper wire 8 has a surface 70 which contacts such upper wire 8 and this surface 70 comprises a first portion 4c which is substantially flat and a subsequently arranged second portion 4d which is substantially convexly curved with respect to the upper wire 8.

Finally, FIGS. 5 and 6 depict two further embodiments, each of which contain a longitudinal wire section 66 arranged forwardly or upstream of the location where the upper wire 9 and lower wire 8 converge or join one another. The headbox 10 is disposed at the starting portion of this longitudinal wire section 66 which constitutes part of the lower wire 9. Such arrangements are also referred to in the papermaking art as 10 hybrid formers. Depending upon the desired operating conditions and the geometry, it is also possible to design a deflection roll, which is arranged forwardly or at the upstream end of the upper wire 8, as a forming cylinder 11, as particularly depicted for the embodiment of FIG. 6.

While there are shown and described present preferred embodiments of the invention, it is distinctly to be understood the invention is not limited thereto, but may be otherwise variously embodied and practiced within the scope of the following claims.

What is claimed is:

1. A wet section of a twin wire papermaking machine, comprising:

two revolving endless wires travelling in a predetermined direction of movement and defining an upper wire and a lower wire which are guided together at one region of the upper and lower wires;

the lower wire having a web-supporting portion having a section extending in essentially horizontal direction;

at least one headbox from which emerges the fiber stock suspension in a wide jet which arrives at the one region between both of the guided together upper and lower wires where there is dewatered the fiber stock suspension and the web formed therefrom;

an open forming roll provided in the lower wire and about which there is partially trained both the upper wire and the lower wire, the at least one headbox is arranged forwardly of the forming roll so as to define a gap former;

at least one suction box provided in the lower wire immediately downstream of the forming roll, the at least one suction box provided in the lower wire has a surface contacted by the lower wire; and at least part of said surface contacted by the lower wire, as viewed in the predetermined direction of movement of the upper and lower wires, is substantially convexly curved with respect to the lower wire;

at least one top suction device provided in the upper at least one stationary vacuum suction box provided in the upper wire downstream of the at least one top suction device with respect to the predetermined direction of movement of the upper and lower wires, wherein the at least one top suction device provided in the upper wire is arranged between the forming roll and the at lest one suction box provided in the lower wire, the at least one vacuum suction box provided in the upper wire has a surface contacted by the upper wire, as viewed in the predetermined direction of movement of the upper and lower wires, is substantially convexly curved with respect to the upper wire; and at least one separation element provided in the lower wire downstream of the at least one vacuum suction box with respect to the predetermined direction of movement of the upper and lower wires.

2. The wet suction of a twin wire papermaking machine according to claim 1, wherein:

the lower wire comprises an uppermost point; and the at least one suction box provided in the lower wire contacting the uppermost point of the lower wire.

3. The wet section of a twin wire papermaking machine according to claim 1, wherein:

the at least one vacuum suction box provided in the upper wire has a front edge; and said front edge being located at a greater elevational positional than the section of the lower wire which extends in essentially horizontal direction.

4. The wet section of a twin wire papermaking machine according to claim 1, wherein:

the at least one vacuum suction box provided in the lower wire has a predetermined length in the predetermined direction of movement of the lower wire;

the at least one suction box provided in the upper wire has a predetermined length in the predetermined direction of movement of the upper wire; and the predetermined length of the at least one vacuum suction box provided in the upper wire is greater than the predetermined length of the at least one suction box provided in the lower wire.

5. The wet section of a twin wire papermaking machine according to claim 1, further including:

pressure elements arranged beneath the at least one vacuum suction box provided in the upper wire; and said pressure elements being elastically pressable towards the lower wire.

6. The wet section of a twin wire papermaking machine according to claim 1, wherein:

the forming roll comprises an upper apex point and a lower apex point.

7. The wet section of a twin wire papermaking machine according to claim 6, wherein:

the upper wire and the lower wire are trained around the forming roll at least at the upper apex point of the forming roll.

8. The wet section of a twin wire papermaking machine according to claim 1, wherein:

the at least one headbox comprises a multi-ply headbox.

9. The wet section of a twin wire papermaking machine according to claim 1, wherein:

the lower wire includes a rear portion as viewed with respect to the predetermined direction of movement of the upper and lower wires; and the rear portion of the lower wire extending substantially in horizontal direction.

10. The wet section of a twin wire papermaking machine according to claim 9, wherein:

the rear portion of the lower wire which extends substantially in horizontal direction is arranged downstream of the at least one separation element as viewed with respect to the predetermined direction of movement of the upper and lower wires.

11. The wet section of a twin wire papermaking machine according to claim 1, wherein:

the at least one top suction device provided in the upper wire defines a first top suction device;

a second top suction device provided in the upper wire;

the at least one suction box provided in the lower wire defines a first vacuum suction box; and a second vacuum suction box provided in the lower wire.

12. The wet section of a twin wire papermaking machine according to claim 1, further including:

pressure elements arranged beneath the at least one suction box provided in the upper wire;

said pressure elements being elastically pressable towards the lower wire;

the at least one vacuum suction box provided in the upper wire has a surface which contacts the upper wire; and said surface comprising a first portion which is substantially flat and a subsequently arranged second portion which is substantially convexly curved with respect to the upper wire.

13. The wet section of a twin wire papermaking machine according to claim 1, wherein:

the total length of the upper and lower wires contacted by the suction boxes provided in the upper and lower wires is greater than the circumferential length of the forming roll wrapped by the upper and lower wires.

14. The wet section of a twin wire papermaking machine according to claim 1, wherein:

the suction boxes provided in the upper and lower wires define a forming path; and the entire forming path descending as viewed with respect to the predetermined direction of movement of the upper and lower wires.

15. The wet suction of a twin wire papermaking machine according to claim 1, wherein:

the upper wire and the lower wire are trained around the forming roll through a wrap angle of about 45°.

* * * * *